US006581218B1

(12) United States Patent
Koepenick, III

(10) Patent No.: US 6,581,218 B1
(45) Date of Patent: Jun. 24, 2003

(54) WATER CONSERVATION APPARATUS

(76) Inventor: Edward L. Koepenick, III, 21050 Thoreau Ct., Sterling, VA (US) 20164

( * ) Notice: Subject to any disclaimer, the term of this patent is extended or adjusted under 35 U.S.C. 154(b) by 0 days.

(21) Appl. No.: 10/032,453

(22) Filed: Jan. 2, 2002

(51) Int. Cl.[7] ..... A47K 3/28

(52) U.S. Cl. ..... 4/605; 4/597; 4/559; 220/571; 220/23.83

(58) Field of Search ..... 4/597, 605, 559, 4/546, 655; 222/305, 556; 220/4.01, 4.21, 4.24, 23.83, 23.2, 23.4, 501, 571, 572

(56) References Cited

U.S. PATENT DOCUMENTS 979,682 A * 12/1910 McLeod ..... 222/305
4,296,838 A * 10/1981 Cohen ..... 184/106
4,488,584 A * 12/1984 Hestehave et al. ..... 141/339
4,640,431 A * 2/1987 Harrison ..... 220/573
5,140,714 A * 8/1992 Horenstein et al. ..... 4/597
5,168,586 A * 12/1992 Small ..... 4/597
5,392,945 A * 2/1995 Syrek ..... 220/608
5,549,227 A * 8/1996 Klotz ..... 141/331
5,611,377 A * 3/1997 Maguire ..... 141/98
5,615,798 A * 4/1997 Luburic et al. ..... 220/572
5,884,676 A * 3/1999 Sage ..... 141/106
6,360,918 B1 * 3/2002 Butler ..... 222/136

* cited by examiner

*Primary Examiner*—Gregory L. Huson
*Assistant Examiner*—Amanda Flynn
(74) *Attorney, Agent, or Firm*—Alfred F. Hoyte, Jr.

(57) ABSTRACT

A water conservation system for use in a shower stall or a bathtub having a shower head. The system includes a pair of receptacles placed on the floor of the shower stall. Each of the receptacles includes a cover, which has a hingedly connected panel to facilitate draining into a selected receptacle while a user is in the shower/bathtub. Collection of clear water is facilitated by directing the shower head at a first one of the receptacles when the water is warming up, and pivoting the shower head in the opposing direction when rinsing to direct gray or soapy water into a second one of the receptacles. The appropriate receptacle cover panel is opened depending upon the positioning of the shower head. Drains are formed in the tops of both receptacles, the tops having a drainage surface with a concave profile to direct water to a centrally positioned drain opening. Each of the receptacles has a removable pour spout, and a locking member is provided to prevent relative movement of the receptacles.

6 Claims, 2 Drawing Sheets

WATER CONSERVATION APPARATUS

BACKGROUND OF THE INVENTION

The present invention relates in general to water conservation. More particularly, it relates to a method and apparatus for water conservation which facilitates reclamation of both relatively clear rinse water and soapy or "gray" water produced by a shower.

STATEMENT OF THE PRIOR ART

Numerous types of water conservation methods and apparatuses have been devised for conserving water used when bathing or showering. Shower heads having a limited flow rate are required by law in some jurisdictions, as are other mandatory water conservation devices and systems (e.g., 1.7 gallon toilets). Some water conservation methods and associated apparatuses take advantage of the fact that a fair amount of water is wasted simply waiting for the water to warm to an acceptable temperature. When a shower is being taken for example, an additional amount of water is wasted while the user is lathering, and this water is mostly soap free. The apparatuses associated with prior art conservation systems tend to be costly, and usually involve a fair amount of modification to the existing plumbing. Thus, both the hardware costs and the installation cost must be factored in when determining the overall cost of the system.

U.S. Pat. No. 4,554,688 issued to Puccerella discloses a water saving system which re-circulates rinse water back into the water supply line. The system includes a recirculating pump, a water heater, and a solenoid operated valve. Substantial plumbing modifications and installation costs are necessary to implement the system.

U.S. Pat. No. 4,112,972 issued to Lajeuness discloses a waste water reclamation system which uses a diverter valve disposed in the drainage conduits of a structure or dwelling place. The diverter valve diverts "gray" water to a conduit having an outlet which directs the gray water to a reclamation area.

U.S. Pat. No. 4,893,364 issued to Keeler discloses a water recycling shower wherein water is recycled using a recirculation system which includes a pump, a series of conduits, and a storage tank.

None of the above inventions and patents, taken either singly or in combination, is seen to describe the instant invention as claimed.

SUMMARY OF THE INVENTION

The present invention overcomes the disadvantages of the prior art by providing a water conservation system for use in a shower stall or a bathtub having a shower head. The system includes a pair of receptacles placed on the floor of the shower stall. Each of the receptacles includes a cover, which has a hingedly connected panel to facilitate draining into a selected receptacle while a user is in the shower/bathtub. Collection of clear water is facilitated by directing the shower head at a first one of the receptacles when the water is warming up, and pivoting the shower head in the opposing direction when rinsing to direct gray or soapy water into a second one of the receptacles. The appropriate receptacle cover panel is opened depending upon the positioning of the shower head. Drains are formed in the tops of both receptacles, the tops having a drainage surface with a concave profile to direct water to a centrally positioned drain opening. Each of the receptacles has a removable pour spout, and a locking member is provided to prevent relative movement of the receptacles.

Accordingly, it is an object of the invention to provide a water conservation system.

It is another object of the invention to provide a water conservation system which may be used with any shower stall or bathtub having a pivotable shower head.

It is another object of the invention to provide a water conservation system having a pair of receptacles for reclaiming waste water generated in a shower.

It is another object of the invention to provide a water conservation system which allows for separate containment of gray water and relatively clear rinse water.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
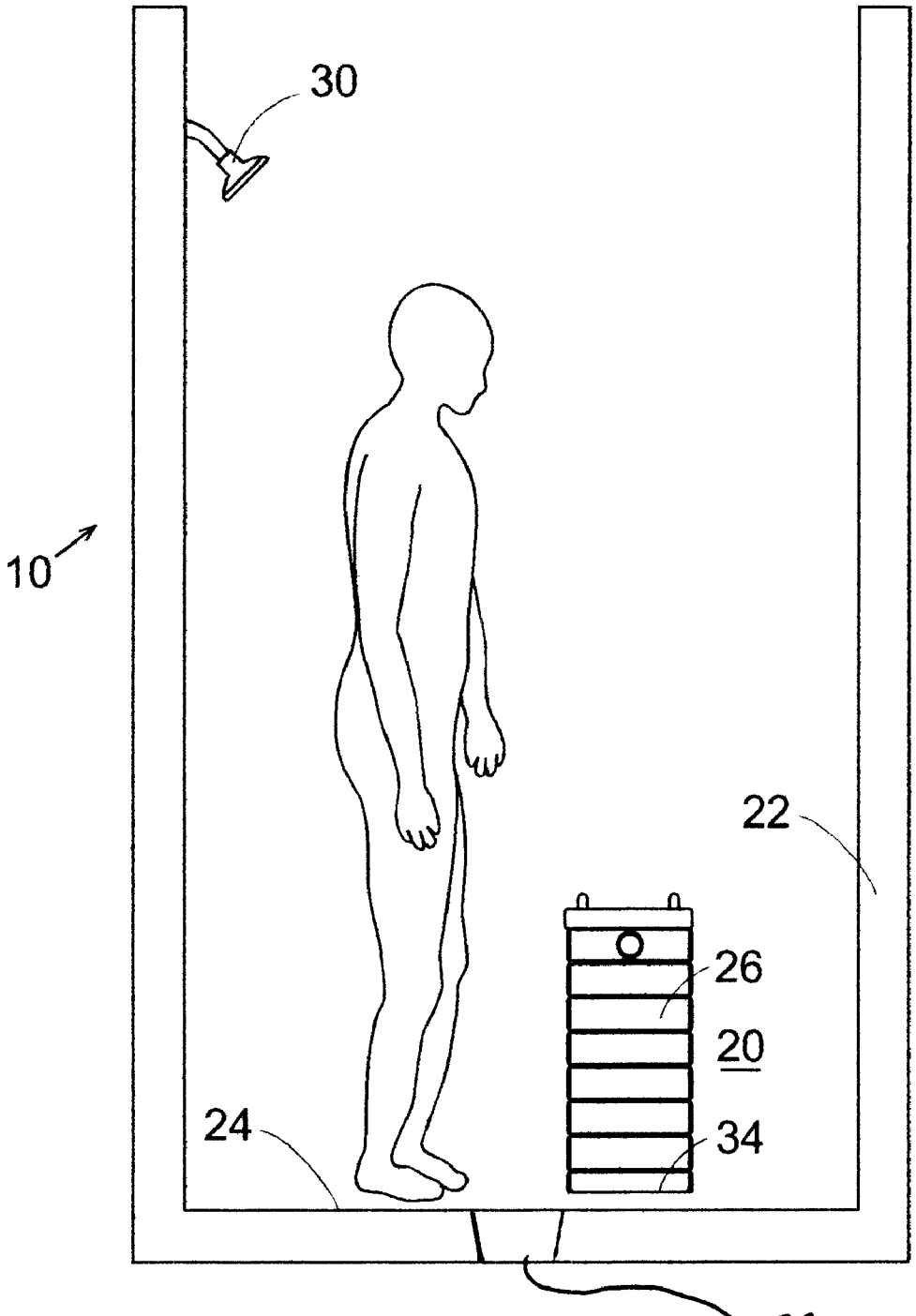
FIG. 1 shows a side cross sectional view, partly in section, of the apparatus of the present invention in use in a shower stall.
Figure 3:
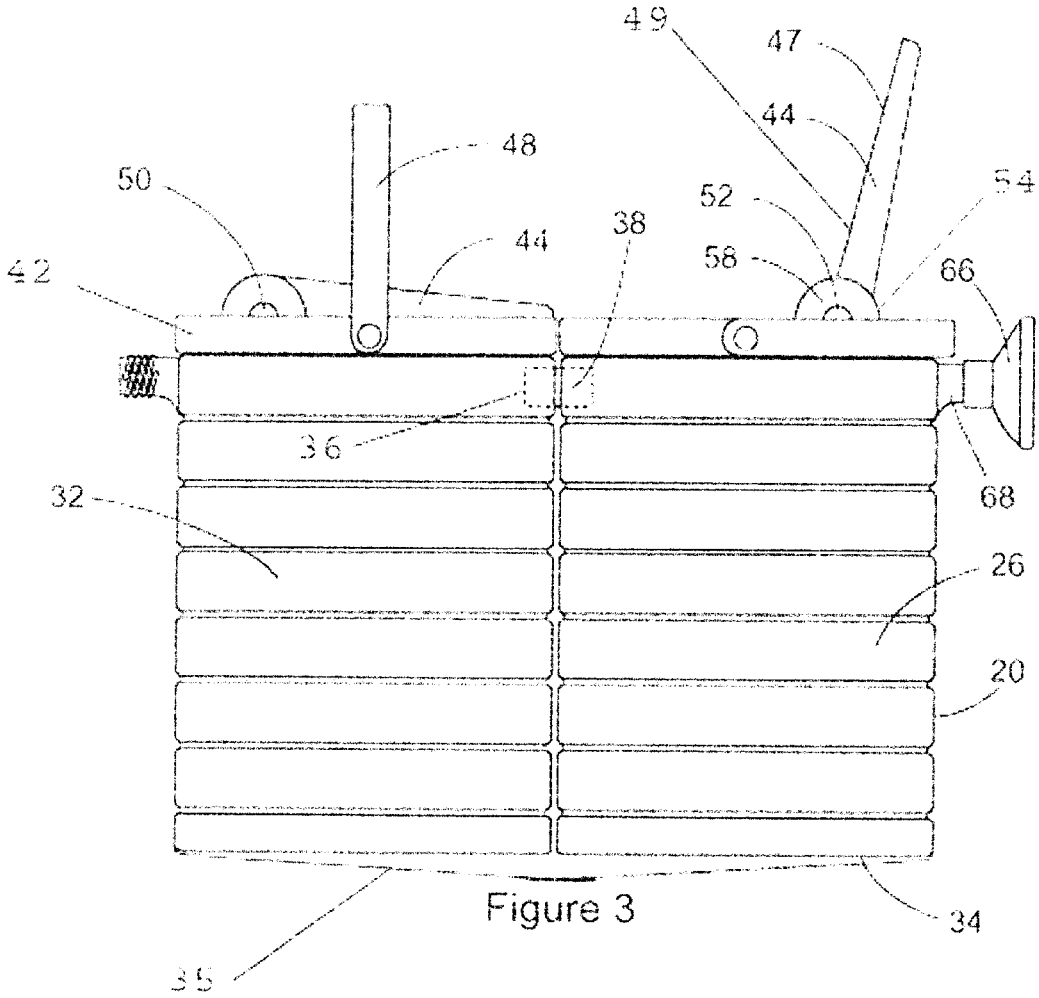
FIG. 3 shows a side view of the apparatus, detailing the cover assembly.
Figure 2:
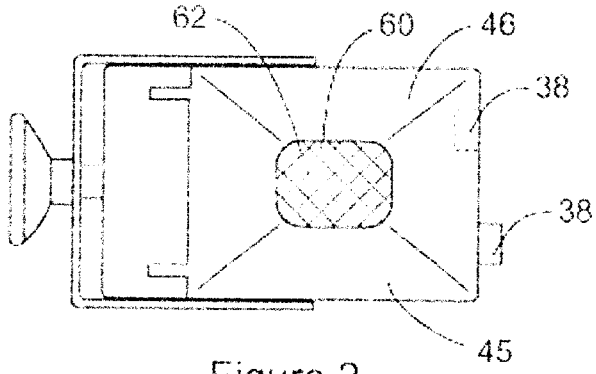
FIG. 2 shows a plan view of one of a pair of receptacles for reclaiming waste water.

Referring now to FIGS. 1–3, the apparatus of the present invention, generally indicated by the numeral 10, is shown. The apparatus includes a pair of waste water reclamation receptacles 20. A first one of the receptacles 20 can be used to collect gray or soapy water rinse water, while a second one of the receptacles 20 can be used to collect relatively clear rinse water generated while the water is warming to a desired temperature. Of course, selection of the receptacle 20 to collect gray water is arbitrary, but must be maintained until the receptacle 20 is full. Indicia may be placed upon the receptacle 20 to allow the user to distinguish the gray water receptacle 20 from the "warm-up" rinse water receptacle, as will be explained in more detail later. The warm-up rinse water may be used for practically any purpose, and may even be reused as drinking water. Gray (soapy) water, which precipitates as the user is lathering and rinsing, can be used, e.g., for flushing toilets or for other uses where clear water is not required. An advantage of the apparatus 10, over many of the prior art apparatuses, is that it relies solely upon gravity to direct water flow and therefore does not require any type of pumping system or source of fluid pressure. Also, the hardware is relatively inexpensive, and does not require any plumbing modifications.

Referring particularly to FIG. 1, the apparatus 10 is shown disposed within a shower stall 22. The apparatus 10 including the two receptacles 20 is disposed on the floor 24 of the bathtub or shower stall 22. The shower stall 22 includes a shower head 30 which is connected to a source of water pressure as is well known. The shower head 30 is pivotable and is used to direct water into receptacles 20 for reclamation as will be explained in more detail later. Each receptacle includes a hollow main body 26 having a generally rectangular shape. Preferably, the receptacles 20 are fabricated from a heavy duty, rigid plastic material, as a metal container may mar the floor 24 of the bathtub or shower stall 22. The material may be clear in order to allow the user to discern the water level contained within the receptacles 20. Alternatively, a vertically oriented window (not shown) may be disposed within sidewall 32. In order to ensure sufficient collection capacity for the receptacles 20 the height of receptacle sidewall 32, should be in the range of 12 to 16 inches. The receptacles 20 should be limited to a maximum capacity of 10 gallons, to keep the weight of the receptacle 34 of the receptacle 20 is flat to ensure maximum surface to surface contact area with the floor 24. Alternatively, a contoured bottom 35 may be employed, the contour chosen to approximate the contour present in many bathtubs. In either case, a rubberized material may be integrally formed with or adhered to the bottom 34 to enhance traction with the floor 24. Each receptacle has an annular recess 36 formed in one sidewall 32, the annular recesses 36 axially alignable to allow for insertion of a dowel 38 between the two receptacles. Dowel 38 serves to prevent relative movement of the two receptacles 20. Thus, the combination of dowel 38 and contoured or traction enhanced bottom surface 34 provide sufficient positional stability for the apparatus 10.

Each receptacle 20 has a top or cover 42 which has three main components, a hinged cover panel 44, a contoured draining panel 46, and a pivotable handle assembly 48. The hinged cover panel 44 is preferably made from the same rigid, durable material as the receptacle 20. The cover panel 44 may include indicia to indicate whether gray or clear water is to be contained therein. Also, an appropriate sealing means may be employed to ensure a water tight relation between cover panel 44 and draining panel 46. For example, an edge portion 45 of the draining panel 46 may be flat, while the corresponding edge portion 47 of cover panel 44 may have a compressible rubberized sealing element 49. Of course, any other sealing means as may be apparent to one of skill in the art may be employed. In accordance with a preferred embodiment of the invention, the receptacles 20 are dimensioned to provide the maximum possible surface area for the draining panel 46, given the above mentioned parameters, e.g., 10 gallon maximum, approximately 12 inches in height, and the interior dimensions of conventional bathtubs and shower stalls 22. Also, multiple receptacles 20 may be used to increase the effective water capturing surface area of drainage panels 46, while decreasing the weight of any one receptacle 20 and increasing the overall water storage capacity.

Hinge 50 may be formed from a pair of mutually opposed rods 52 extending from one edge of the cover panel 44, the rods 52 sized for rotational engagement within annular recesses 54 formed in knuckle 58 which extends upwardly from draining panel 46.

Draining panel 46 includes a centrally disposed drain opening 60 which may include a mesh covering 62 to prevent large objects from falling into the receptacle 20. The panel 46 may fit snugly over the upper edges of sidewalls 32. Alternatively, panel 46 and sidewalls 32 may be of unitary construction. In order to effect cleaning of the receptacles 20, the mesh covering 62 and drain opening 60 may be circular, and the mesh covering component 62 may have a threaded rim (not shown) sized for threaded engagement within drain opening 60 to allow for periodic removal. The draining panel 46 is contoured, with a downwardly sloping profile to funnel water into the receptacle 20.

Pivotable handle assembly 48 facilitates removal of the receptacles 20 from the bathtub or shower 22. Pour spout 66 is preferably threadedly engaged with conduit 68 to allow for easy removal when additional lateral clearance is required. A stopper (not shown) may be placed on the end of conduit 68. Alternatively, conduit 68 may be left open ended to allow for runoff when the receptacle 20 reaches capacity. Excess water flowing from conduit 68 may flow down the exterior of sidewalls 32 onto the floor 24 of the bathtub or shower stall 22, where it may flow into and through drain opening 72.

In use, both receptacles 20 are placed in side by side relation into the bathtub or shower stall 22. Dowel 38 should be inserted between the receptacles 20 as discussed above. The receptacles 20 are preferably positioned so that the user stands between the water flow emanating from the shower head 30 and the receptacles 20 as can be seen in FIG. 1. After positioning the shower head 30 to direct water flow into the receptacle 20 designated for clear water, the user opens the appropriate cover panel 44 to allow warm up water to flow into the selected receptacle 20. The user may then close the first cover panel 44, redirect the shower head 30 in the direction of the adjacent receptacle 20, and open the adjacent cover panel 44 to allow gray water to flow into the adjacent (i.e., designated for gray water) receptacle 20. When the user has finished showering, he may then check to see if either receptacle 20 has reached capacity, and dispense with the water contained therein as desired.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

1. A water conservation receptacle assembly for placement in a tub or shower stall, said tub or shower stall having a shower head connected to a source of water, said shower head pivotable to direct water to opposing sides of said tub or shower stall, said assembly comprising:

a pair of receptacles, each of said receptacles having a main body with a hollow interior portion and a cover assembly, each of said cover assemblies having a draining panel formed therein and a cover panel hingedly attached thereto, one of said receptacles positioned on one of said opposing sides of said tub or shower stall, with the other of said receptacles positioned on another of said opposing sides of said tub or shower stall;

said draining panel having a contoured, downwardly sloping top surface with a central opening disposed above and fluidly coupled to said hollow interior portion;

wherein said cover assemblies form a fluid tight seal with a border portion of said draining panel when in the closed position, and may be separately opened and closed to allow for water to accumulate in a selected one of said pair of receptacles dependent upon positioning of said shower head.

2. The assembly of claim 1 wherein a coupling means is positioned between the receptacles, said coupling means serving to prevent relative movement of said receptacles.

3. The assembly of claim 1 wherein each of said receptacles has a contoured bottom surface, said bottom surface contour corresponding to a contoured support surface in a bathtub or shower stall.

4. A water conservation receptacle assembly for placement in a tub or shower stall, said tub or shower stall having a shower head connected to a source of water, said shower head pivotable to direct water to opposing sides of said tub or shower stall, said assembly comprising:

at least first and second receptacles, each of said receptacles having a main body with a hollow interior portions and a cover assembly, each of said cover assemblies having a draining panel formed therein and a cover panel hingedly attached thereto, said first receptacle positioned on a first one of said opposing sides of said tub or shower stall, said second receptacle positioned on a second one of said opposing sides of said tub or shower stall;

said draining panel having a contoured, downwardly sloping top surface with a central opening disposed above and fluidly coupled to said hollow interior portion;

the drainage panel of said first receptacle positioned to receive water from said shower head when said shower head is pivoted to direct water to said first one of said opposing sides.

5. The assembly of claim 4 wherein said draining panel of said second receptacle is positioned to receive water from said shower head when said shower head is pivoted to direct water to said second one of said opposing sides.

6. A water conservation method for use in a shower facility having a pivotable shower head comprising:

positioning first and second receptacles, each of said receptacles having a hollow main body with a cover assembly, said cover assembly having a draining panel formed therein and a cover panel hingedly attached thereto;

collecting clear rinse water in said first receptacle by pivoting said cover panel associated therewith to a water receiving position when said shower head is positioned to direct said rinse water onto said first receptacle draining panel; and, collecting gray water in said second receptacle by pivoting said cover panel associated therewith to a water receiving position when said shower head is positioned to direct said gray water onto said second receptacle draining panel.

* * * * *